US005158519A

United States Patent [19]

Hughes

[11] Patent Number: 5,158,519

[45] Date of Patent: Oct. 27, 1992

[54] BODY EXERCISER USING MULTI-SURFACED, DISTRIBUTED FRICTIONAL BRAKE MEANS

[76] Inventor: Paul G. Hughes, 2013 Bodega Ave., Petaluma, Calif. 94552

[21] Appl. No.: 668,591

[22] Filed: Mar. 13, 1991

[51] Int. Cl.[5] ..... A63B 21/015

[52] U.S. Cl. ..... 482/118; 482/115

[58] Field of Search ..... 272/132, 131, 93, DIG. 3, 272/73, DIG. 4; 128/25 R; 482/115, 118

[56] References Cited

U.S. PATENT DOCUMENTS

| | | | |
|---|---|---|---|
| 3,640,525 | 2/1972 | Proctor | 272/132 |
| 4,684,126 | 8/1987 | Dalebout et al. | 272/132 |
| 4,869,492 | 9/1989 | Joutras | 272/132 |

*Primary Examiner*—Stephen R. Crow
*Attorney, Agent, or Firm*—Harold D. Messner

[57] ABSTRACT

In accordance with the invention, an exerciser is described which comprises a simple structure comprised of elements which can be readily assembled while at the same time generate a large, distributed resistance load in which the user's limbs can be worked in both push-pull only, or push only movements. The exerciser comprises essentially two cranks journaled from opposite directions into independently operating friction brakes for independent operation of the cranks by the user. However, the friction brakes of each crank while independently operatable are interconnected by a common frictional biasing plates housed within a horizontally extending, central housing and having an activation rod that extends exterior. The biasing plates generates biasing pressure at a pair of push blocks centrally disposed within the housing to cause bidirectional movement of the latter toward fixed end blocks of the housing. Since each friction brake also includes a series of stackable, laterally slidable, rotatable and stationary members, such squeezing pressure brings all vertical surfaces of these members into frictional contact with each other. Since the rotatable and stationary members are equally distributed over a finite length of the crank arm, the resistance loads to rotation are smooth over a full 360 degrees of rotation.

17 Claims, 5 Drawing Sheets

BODY EXERCISER USING MULTI-SURFACED, DISTRIBUTED FRICTIONAL BRAKE MEANS

SCOPE OF THE INVENTION

The present invention relates to body exercisers and more particularly to methods and means for exercising large muscles of a person in tandem or independently using such exercisers wherein resistance to movement of separately liftable and retractable cranks of such exercisers is provided by independently operating friction brakes interconnected by a common frictional biasing means. In one aspect, biasing pressure for the frictional brakes is provided by a bidirectionally acting, calibrating rod assembly adjusted exteriorly of a central housing by the user.

BACKGROUND OF THE INVENTION

Today's push for health has evoked the marketing of a number of exercising devices. However, because of cost and complexity of parts, most must be sold to the upper segment—incomewise—of the population, especially those devices that provide exercise loading in a range of 100–300 pounds at conventional lifting lengths. As well understood, exercisers in the latter cost range permit larger muscles of a person, such as arms and legs, to be manipulated in the presence of resistance.

In my U.S. Pat. No. 3,717,338 for "Wrist Exercising Device", I describe an exerciser for wrists in which oppositely rotatable cylinders are interfaced at central enlarged discs. While such a device is adequate for strengthening wrists, hands and forearms in a cost effective manner, my invention also required the working of both hands for operations in opposite angular directions to provide the needed resistance loading for the user. Therefore, my device was limited to exercising the smaller muscles of the body.

SUMMARY OF THE INVENTION

In accordance with the invention, an exerciser is described which comprises a simple structure composed of a paucity of elements which can be readily assembled while at the same time can generate a surprisingly large, distributed resistance load (say up to 350 pounds at conventional lifting lengths) without using pulley- or cable-pressure whereby the user's limbs can be worked in both push-pull, pull only or push only replications. The exerciser comprises essentially two cranks journaled from opposite directions into independently operating friction brakes for like-independent operation of the cranks by the user. However, the friction brakes of each crank—while independently operatable—are interconnected by a common frictional biasing means housed within a horizontally extending, central housing but having an activation rod that extends exterior. The biasing means generates biasing pressure at a pair of push blocks centrally disposed within the housing to cause bidirectional movement of the latter toward fixed end blocks of the housing. Since each friction brake also includes a series of stackable, laterally slidable rotatable and stationary members, such squeezing pressure brings all broad vertical surfaces of these members into frictional contact—sandwich style—with each other. Also, since the rotatable and stationary members are equally distributed over a finite length of the crank arm, the resistance loads to rotation are surprisingly smooth over a full 360 degrees of rotation.

During adjustment prior to the exercise session, the pressure biasing means generates squeezing forces at the push blocks adjacent to the plane of action in a rapid manner. Source of oppositely directed movement of the push blocks relative to the plane of action: a common operating calibration-rod assembly (called cal-rod assembly for short) initiated by the user. That is, cal-rod assembly permits lengthwise common adjustment in both friction brakes simultaneously relative to the fixed end blocks of the housing. In more detail, cal-rod assembly includes a central rod that is rotatable about its axis of symmetry. Rotation of the rod is translated into rectilinear movement of a calibration member of square cross section by means of a threaded bushing-spring subassembly attached to the calibration member. Rectilinear movement of the calibration member and subassembly pushes a compression spring into contact with the first push block in the first direction. After initial contact, the rectilinear direction of movement is then opposed by the spring force generated by the compressing spring. As the magnitude of spring force becomes greater than the frictional forces acting on the rod, called a set-point, further rotation causes opposite rectilinear travel of the rod in the opposite direction. This opposite movement draws a fixed nerd welded to the rod into contact with the second push block. Thence further rotation causes bi-directional movement of both push blocks in opposite directions and hence squeezes the stationary and rotatable members together relative to the fixed end blocks.

After the separate pairs of push and end blocks become momentarily welded together into independent units, angular movement of each crank—while independent—is directly related to the generated friction force generated by the common friction biasing means of the invention. Furthermore, if the housing is slotted in the vicinity of the calibration member, the rectilinear movement of the latter after the push and end blocks become welded together as a single unit, can also be used as an indicator of magnitude of resistance loading. In order to aid in the indication process, resistance loading values are marked on an exteriorly viewable scale adjacent to the slot. In addition, each crank includes a forearm exterior of the housing and a lateral arm having a large portion interiorly disposed with the housing in contact with the rotatable members of each friction brake but having a small segment that extends exterior of the fixed housing for connection to the forearm.

Attachment of the lateral and fore arms is preferably via a ratchet mechanism to permit push-pull, push only or pull only repetitions by the user, i.e., in both rotary directions of the forearm, in a clockwise direction only or in a counterclockwise direction only. The ratchet includes a pair of tear-dropped plates sandwiching a gear, the latter being attached to the lateral arm and rotatable therewith. Attachment between the gear and tear-dropped plates is via a pair of spring-loaded pawls that operationally engage the gear. Selection of pawls and hence direction of rotation is via a trigger attached at the exterior of one of the plates. Various handle configurations can also be attached to the forearms of the cranks to permit the user to perform various pushing, pulling exercising for strengthen the arms, shoulders, back, legs, etc., and other parts of the body, particularly for professional athletes including weight lifters, body builders, football, baseball and basketball players, golfers, and race car drivers.

From the preceding discussion, it is seen that the invention has as its objects, inter alia, the provision of an improved exerciser composed of few and simple elements which can be assembled easily at low cost but which has surprising versatility wherein surprisingly large resistance loads to movement via one or the other crank arms can be generated whereby the larger muscles of the user can be worked in both push-pull pull only or push only replications. Other objects of the invention will become apparent from the following more detailed description and accompanying drawings in which:

PREFERRED DESCRIPTION OF AN EMBODIMENT OF THE INVENTION

Figure 1:
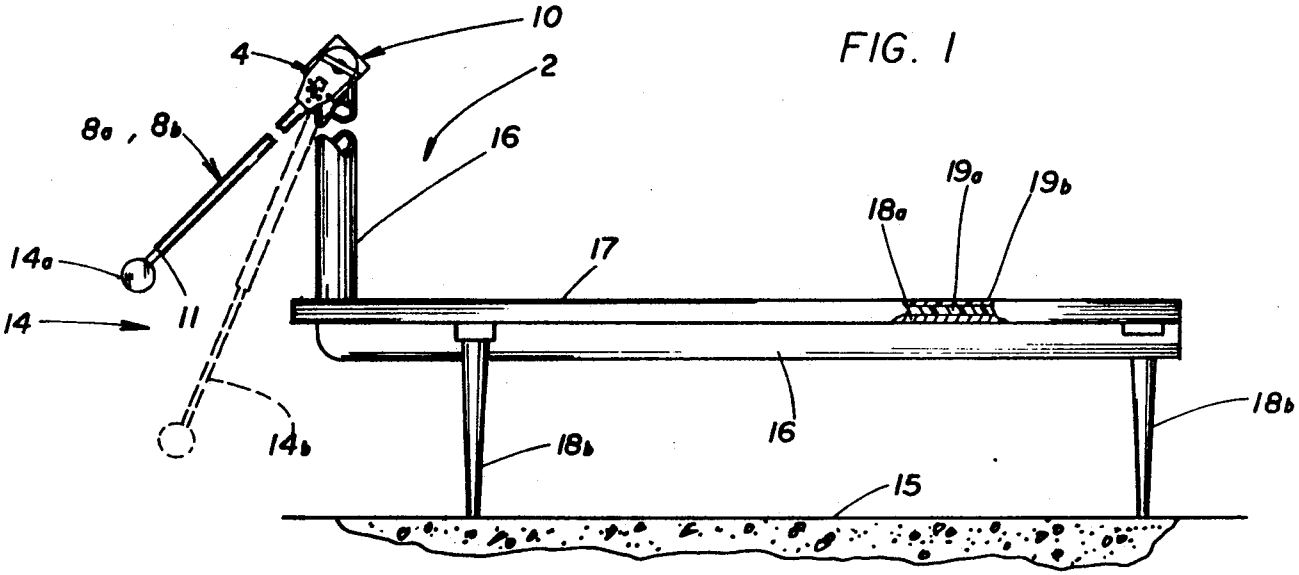
FIGS. 1 and 2 are side and front elevational views of the exerciser of the invention partially exploded to illustrate various handle configurations attachable to two cranks journaled from opposite directions into a central housing that is affixed to a permanent support structure, such as an exercise bench.
Figure 2:
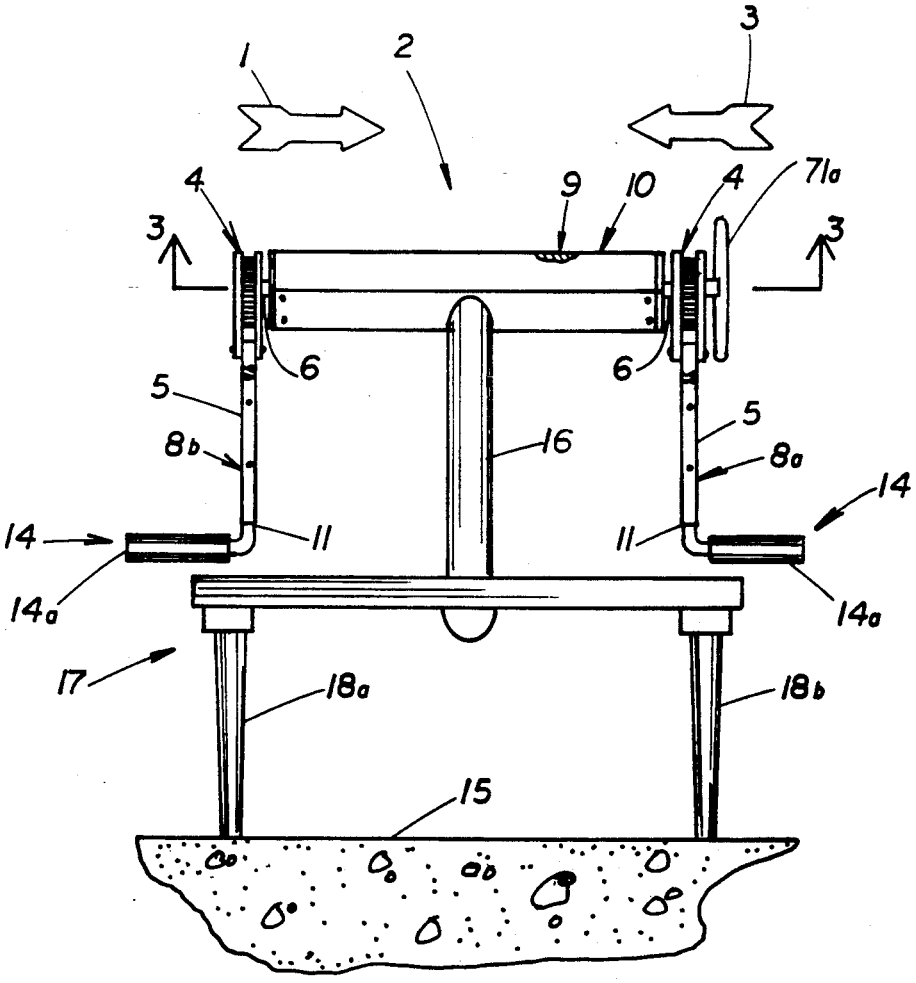

FIGS. 1 and 2 are side and front views of the exerciser 2 of the invention. The exerciser 2 comprises a simple structure composed of a paucity of elements which can be readily assembled while at the same time can generate a surprisingly large resistance load without using pulley- or cable-pressure. In that way the larger muscles of the user can be worked in both push-pull, pull only or push only replications.

In more detail, the exerciser 2 is comprised essentially of two cranks 8*a*, 8*b* and independently operating friction means 9 housed within a central housing 10. Each crank 8, 9 is L-shaped and comprises a forearm 5, a lateral arm 6 and a ratcheting mechanism 4, the forearm 5 and lateral arm 6 being interconnected via the rachet mechanism 4. The forearm 5 includes an end 11 remote from the central housing 10 that is connectable to one of a series of action arms—separately—generally indicated at 14 to permit different muscles of the user to be worked. For example, (i) a L-shaped arm-handle 14*a* is shown and is used for arm lifts, arms curls and arm stretches above a floor 15 using a goose-necked attachment 16 attached to an exercise bench 17 composed of flat support 18*a*, legs 18*b*, plastic ticking 19*a* and cover 19*b* overlaying the support 18*a*, the attachment 16 extending over the horizontal extent of bench 17. Note in the embodiment of item (i) that handle 14*a*′ is parallel to the floor 15 and is operated either over limited arcuate ranges, say 90 degrees or over a full 360 degree rotation; and (ii) a second embodiment in which L-shaped arm-handle 14*b* (shown in FIG. 2 in phantom line) is located below the exercise bench 17) in which the handle 14*b*′ is parallel to the floor 15 and is operated over limited arcuate ranges for leg stretches and/or curls. However, it should be noted that a separate L-shaped arm-handle could be added to the above-disclosed embodiment without undue experimentation, e.g., adjacent to a seat of an automobile in which the handle is perpendicular to the floor to emulate a gear-shift lever of a race car.

A separate lateral arm 6 of each crank 8*a*, 8*b* has a major portion (not shown) positioned within the central housing 10 and extended therein from an opposite direction indicated by arrows 1, 3. The ends of the arms 6 are journaled interior of the friction braking means 9 within the central housing 10.

Figure 3:
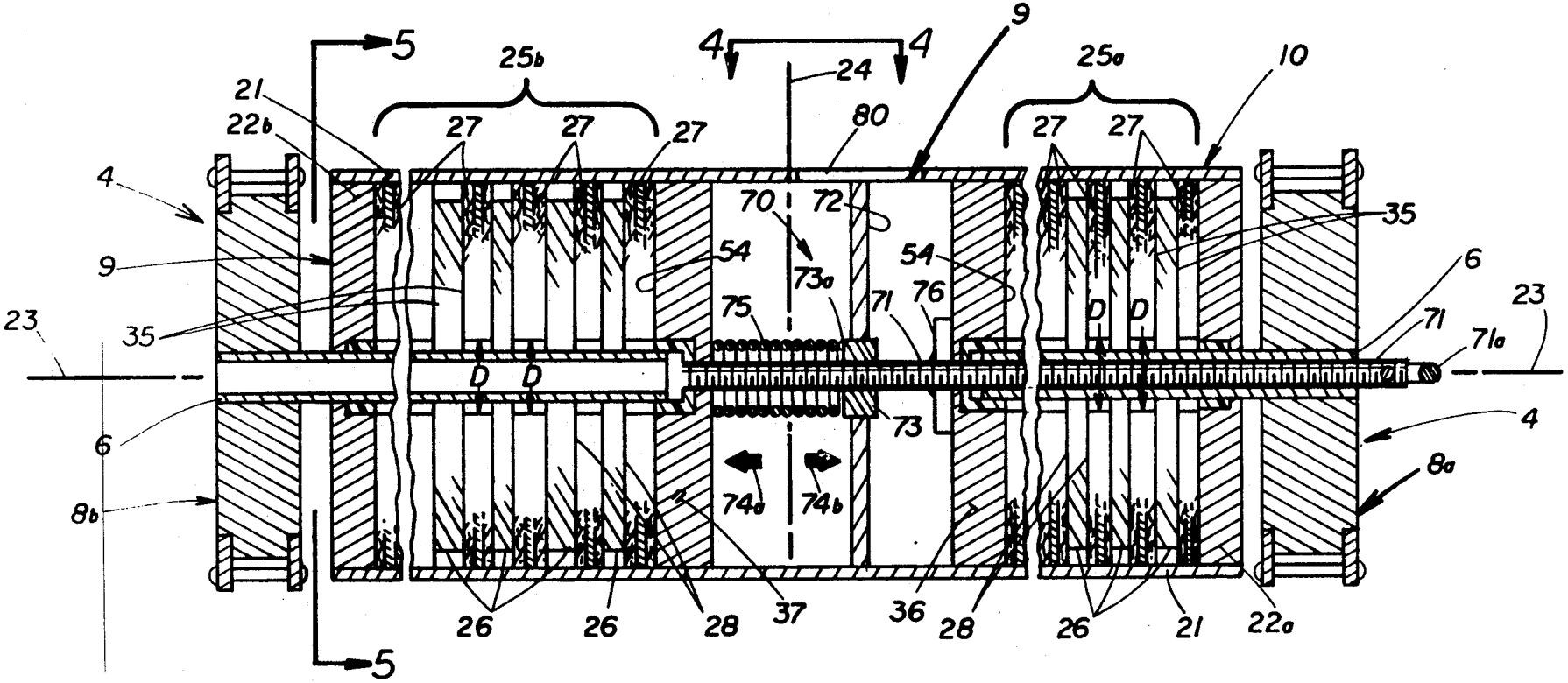
FIG. 3 is an enlarged section taken along line 3—3 of FIG. 2 to illustrate how the two cranks operatively attached to a pair of friction braking means within the housing of FIGS. 1 and 2, each braking means including a series of rotatable and stationary members having broad surfaces in alternate frictional contact, the rotatable members attached to and rotatable with the cranks, all members also being stacked along the cranks but having biasing pressure applied thereto via a calibration-rod assembly having a rod coincident with the axis of rotation of the rotatable members of each braking means, providing for the bi-directional movement of pairs of push blocks interior of the housing, such movement being relative to a fixed plane of action bisecting the housing but normal to the axis of rotation.

FIG. 3 shows the friction braking means 9 and central housing 10 in more detail.

As shown, the friction braking means 9 is housed interiorly of upright side walls 21 in lateral position relative to end blocks 22*a* and 22*b*. Relative to either horizontal axis of symmetry 23 or through vertical plane of action bisecting the housing 10, the side walls 21 are seen to be square in cross section. Thus, along the axis of symmetry 23, different sectioned elements of the braking assembly 20 can be given the capability of rotation about such axis 23 merely because of their shape relative to that of the lateral arm 6 of crank 8*a* or 8*b*.

For example, the braking means 9 includes a first group of members generally indicated at 25*a* and a second group indicated at 25*b*, associated with independent movement of the cranks 8*a* and 8*b*. Each group 25*a*, 25*b* have common axes of symmetry coincident with respect to axis of symmetry 23 of the housing 10 but since the groups 25*a*, 25*b* are similar in construction, description will be limited hereinafter. The group 25*a* or 25*b*, for example, includes a series of interiorly disposed rotatable members 26 and stationary members 27. In this regard, the group 25*a* or 25*b* is subdivided into sets, each set comprising a rotating member 26 and a pair of stationary members 27 in side-by-side sandwich contact along broad surfaces 28 parallel to the vertical plane of action 24. Each set defines a finite length along the lateral arm 6 but together form a distributed loading along a large extent of each lateral arm 6 so as to provide a distributed loading that smoothly resists the rotation of the cranks 8*a*, 8*b*. In this regard at least three separate sets are needed to act in concert relative to movement of each crank 8*a* or 8*b* while four sets per group 25*a*, 25*b* are preferred.

Within each set, the rotating member 26 operative attaches about the lateral arm 6 in a series of distributed contact planes parallel to plane of action 24, i.e., contact occurs at outer surface 30 of walls 31 of the lateral arm 6 (see FIG. 5) in the plane of such contact. This permits such members 26 to rotate in concert with lateral arm 6 about an axis of rotation coincident with axis of symmetry 23.

The stationary members 27 each has a large interior diameter D that same to clear the imaginary circle 33 (see FIG. 5) generated by the rotation of corners 34 of the lateral arm 6 about axis of symmetry 23. Each stationary member 27 also has a large vertical length that place such members 27 in contact with side walls 21 of the central housing 10. Note further that since the distribution of the sets of members 26, 27 must be such both board surfaces 35 of each sandwiched rotating member 26 are in frictional contact with like surfaces of the stationary broad surfaces, there must a stationary member 27 at each end of the combination. That is, there is a stationary member 27 adjacent to and in contact with end blocks **22*a*, 22*b* as well as adjacent to and in contact with interior push blocks 36, 37 at the interior of the central housing 10**.

Of course, the function of such contact is to provide a smooth resistance to rotary movement of the lateral arms 6. In this regard, the stationary members 27 are covered with a material having a high friction coefficient and as previously mentioned, are positioned—sandwich style—about the rotatable members 26 to resist movement of the latter in concert with rotation of the lateral arms 6 as associated cranks **8*a*, 8*b* undergo rotation about axis of symmetry 23**, discussed below.

In order to increase or decrease braking power, a calibration-anchoring rod assembly (called cal-rod assembly hereinafter) 70 is provided. It comprises a rod 71 having an axis of symmetry coincident with the axis of symmetry 23 of the central housing 10, and generates simultaneous bi-directional movement of the member groups **25*a*, 25*b* relative to the vertical plane of action 24. That is, cal-rod assembly 70 permits lengthwise adjustment in opposite horizontal directions of the push blocks 36, 37 relative to the end blocks 22*a*, 22*b* that sandwich the member groups 25*a*, 25*b*. Since the push blocks 36, 37 are movable, they can bring members 26, 27 into squeezing contact with each other against the fixed end blocks 22*a*, 22*b* of the central housing 10**.

In more detail, note that threaded rod 71 has a handle **71*a*. During adjustment, the rod 71 is rotated about axis of symmetry 23, the rod 71 being free-wheeling but positioned along the axis of symmetry 23 in a fixed length-wise position due to its support within the push blocks 36, 37. Rotation of the rod 71 is translated into rectilinear movement of a central calibration member 72. The member 72 is of square cross section and is prevented from rotation due to close proximity to the side walls 21 of the housing 10. However, due its threaded bushing 73 at its center coincident with the axis of symmetry 23, the calibration member 72 and bushing 73 travel in a first direction as indicated by arrow 74*a* toward the plane of action 24. Such movement brings compression spring 75 into contact with push block 37. The compression spring 75 is fixed to shoulder 73*a* of the bushing 73. As the spring 75 undergoes compression, the push block 37 also undergoes movement in the direction of arrow 74*a* (away from the plane of action 24) but causes reactive movement of the rod 71 in the reverse direction as indicated by arrow 74*b* relative to the plane 24. Such reverse movement brings welded flange 76 into contact with the push block 36. Further rotation of the rod 71 increases the braking load on all sets of members 26, 27 in an equal, distributed fashion along the lateral arms 6 of both cranks 8*a*, 8*b***.

Stated another way, after initial contact, the rectilinear direction of movement along arrow **74*a* is opposed by a spring force due to the spring 75. As the magnitude of spring force becomes greater than the frictional forces acting on the rod 71 at the interior of the push blocks 36, 37, called a set-point, further rotation causes opposite rectilinear travel of the rod 71 in the direction of arrow 74*b*, drawing the fixed flange 76 into contact with the push block 36. Thence further rotation causes bi-directional movement of both push blocks 36, 37 in opposite directions and hence squeezes all member groups 25*a*, 25*b* together relative to the fixed end blocks 22*a*, 22*b* of the housing 10. This action increase friction contact of each independently rotatable lateral arm 6 associated with rotation of either crank 8*a* or 8*b* so that the force required to rotate each lateral arm 6 via the cranks 8*a*, 8*b* is evenly distributed within the member groups 25*a* or 25*b*. I.e., after the push blocks 36, 37 and end blocks 22*a*, 22*b* become welded together into a single unit, angular movement of the lateral arms 6 (and hence movement of the rotatable members 26 relative to stationary member 27) is directly related to the force needed to rotate one or both of the cranks 8*a*, 8*b* about the axis of symmetry 23**.

Figure 4:
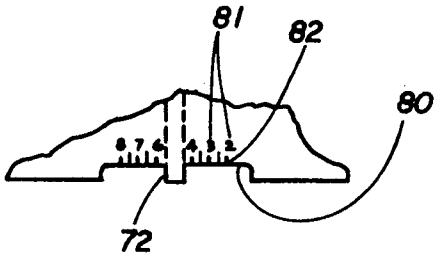

Furthermore, if one of the side walls 21 of the housing 10 is provided with a slot 80 in the vicinity of the calibration member 72, the rectilinear movement of the latter after the push blocks 36, 37 and end blocks **22*a*, 22*b* become welded together as a single unit, the calibration member 72 can also be used as an indicator of magnitude of resistance loading of the braking assembly 20. In order to aid in the indication process as shown in FIG. 4, resistance loading indicia 81 are marked on an exteriorly viewable scale 82 adjacent to the slot 80**.

Figure 6:
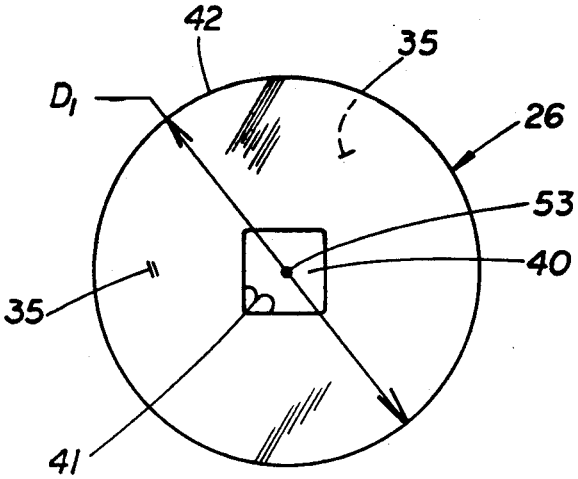
FIGS. 6 and 7 are front elevational and side detail views, respectively, of a rotatable member of each braking means of FIG. 3.
Figure 7:
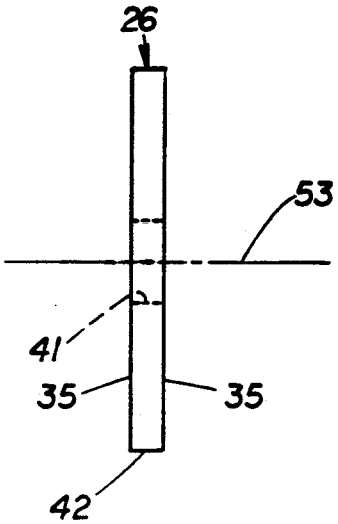

FIGS. 6 and 7 are front elevational and side detail views, respectively, of a rotatable member 26 of FIG. 3 showing the latter in more detail.

As shown, the rotatable member 26 has an interior opening 40 of square cross section. Such opening 40 is defined by side wall 41 and has side lengths that are equal. At outer surfaces of side wall 41 is circumferential surface 42; but note that the side wall 41 includes the broad surfaces 35 previously mentioned by which braking resistance to rotation is obtained. Note the position of the broad surfaces 35: between the opening 40 and the circumferential surface 42. Also as previously mentioned, the opening 40 is sized to fit at the exterior surfaces 30 of the lateral arm 6 of FIG. 5 so that action is in concert. The diameter D1 defined by circumferential surface 42 through axis of symmetry 43 however is less that the distance between opposed side walls 21 of the central housing 10 so that as rotation of the former occurs, interference with the latter cannot occur.

Figure 8:
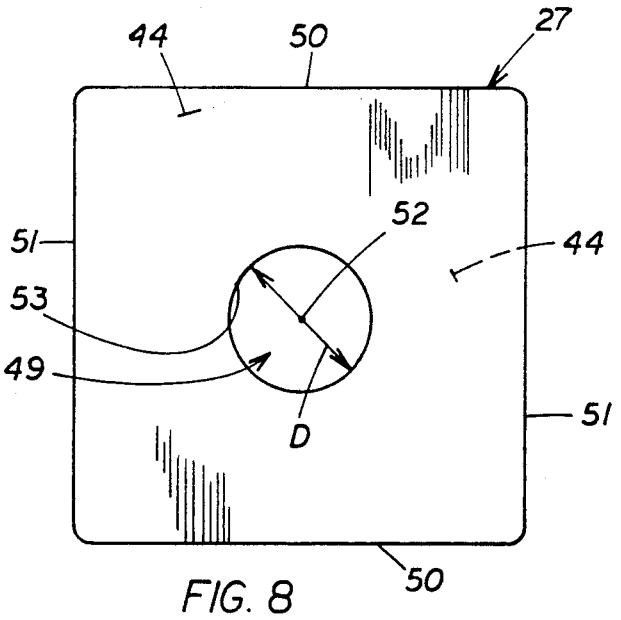
FIGS. 8 and 9 are front elevational and side detail views, respectively, of a stationary member of each braking means of FIG. 3.
Figure 9:
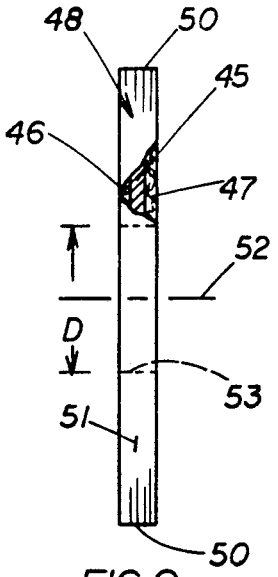

FIGS. 8 and 9 are front elevational and side detail views, respectively, of a stationary member 27 of FIG. 3.

As shown, the stationary member 27 includes first and second broad surfaces 44 that are placed in contact with like surfaces 35 of the rotatable member 26 by which braking resistance is applied to rotation. In this regard, the stationary member 27 includes a metallic support 45 sandwiched between pliant members 46 and 47 (see FIG. 9). Together the metallic support 45 and pliant members 46, 47 comprise the side wall of the stationary member, such side wall being generally indicated at 48. The material comprising members 46, 47 provide a high frictional coefficient. In this regard, any high frictional material may be employed, but the most advantageous has been found to be leather because the latter provides excellent frictional resistance, and at the same time the leather does not fuse together under lateral pressure.

Figure 5:
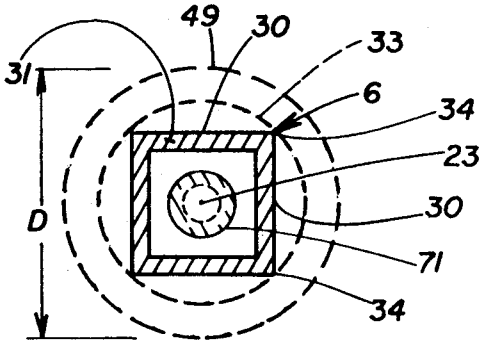
FIGS. 4 and 5 are sections taken along lines 4—4 and 5—5 of FIG. 3 in which the full extent of the elements of FIG. 5 have been restored but in which in FIG. 4 such elements have been left in place.

The stationary member 27 also has an interior opening 49 of circular cross section having the diameter D, the significance of which occurring with reference to FIGS. 3 and 5 having to do with clearance of lateral arm 6 as the latter rotates. Such opening 49 is defined by the side wall 48 previously mentioned, while the outer terminus of the side wall 48 are seen to be horizontal surface 50 and vertical surfaces 51 defining a square cross section, but furthermore, the side wall 48 includes the broad surfaces 44 previously mentioned by which braking resistance to rotation is obtained. Note the position of the broad surfaces 44: between the opening 49 and the terminating surfaces 50, 51. Also as previously mentioned, the opening 49 is sized to clear rotation of lateral arm 6 about the axis of symmetry 23 of FIG. 5 so that interference is avoided. That is, the diameter D defined by axis of symmetry 52 and interior surface 53 of opening 49 is much greater than the circle of rotation 33 of the lateral arm 6 of FIG. 5.

Figure 10:
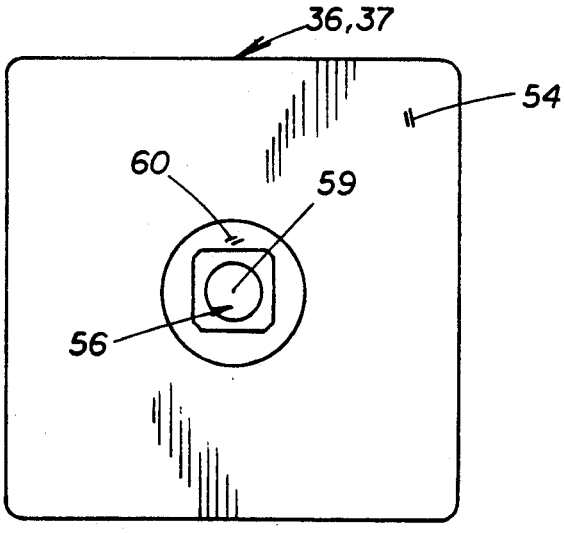
FIGS. 10 and 11 are front elevational and detail side views, respectively, of a centered push block of FIG. 3.
Figure 11:
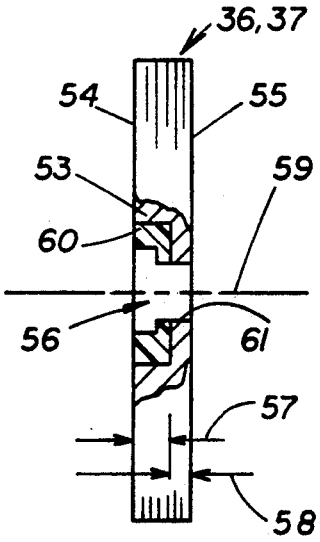

FIGS. 10 and 11 are front elevational and side detail views, respectively, of push blocks 36, 37 of FIG. 3.

As shown, each push block 36, 37 includes first and second broad surfaces 54, 55 wherein only broad surface 54 (see FIG. 3) is placed in contact with like surfaces 44 of a stationary member 27. Each push block 36, 37 also has an interior opening 56 defining a side wall 53, such opening 56 being square in cross section over segment 57 and circular of segment 58 relative to axis of symmetry 59. Within the segment 57 is a pliant bushing 60 into which lateral arm 6 of FIG. 3 can be journaled. With rotation of the latter, such pliant bushing 60 also rotates about the axis 59, while the push block 36 or 37 remains stationary. Within the segment 58 is a guide hole 61 for support of the rod 71 of the cal-rod assembly 70 as previously discussed. The pliant bushing 60 is L-shaped in cross section and is formed of a material of low frictional coefficient. In this regard, any low frictional material may be employed, but the most advantageous has been found to be plastic because the latter provides excellent lubricating characteristics and at the same time the plastic does not fuse together under pressure.

Figure 12:
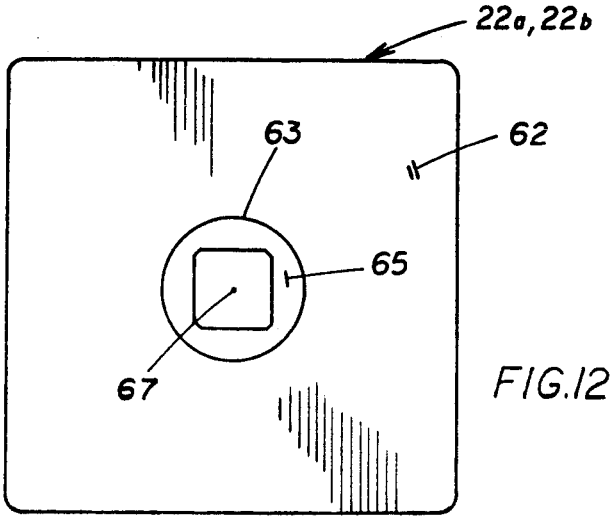
FIGS. 12 and 13 are front elevational and detail side views, respectively, of a end block of the housing of FIG. 3.
Figure 13:
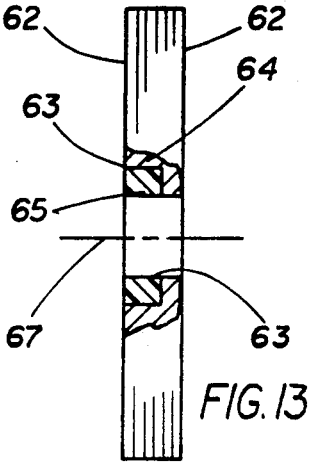

FIGS. 12 and 13 are front elevational and side detail views, respectively, of end blocks 22*a*, 22*b* of FIG. 3.

As shown, each block 22*a*, 22*b* includes first and second broad surfaces 62 wherein one such broad surface 62 is placed in contact with like surfaces 44 of a stationary member 27. Each end block 22*a*, 22*b* also has an interior opening 63 of circular cross section defining a side wall 64 into which a pliant bushing 65 is inserted. The pliant bushing 65 is provided with an opening 66 that is square in cross section relative to axis of symmetry 67 into which the lateral arm 6 of FIG. 3 can be journaled. With rotation of the latter, such pliant bushing 65 also rotates about the axis 67, while the end block 22*a* or 22*b* remains stationary. The pliant bushing 65 is formed of a material of low frictional coefficient. In this regard, any low frictional material may be employed, but the most advantageous has been found to be plastic because the latter provides excellent lubricating characteristics and at the same time the plastic does not fuse together under pressure.

Figure 14:
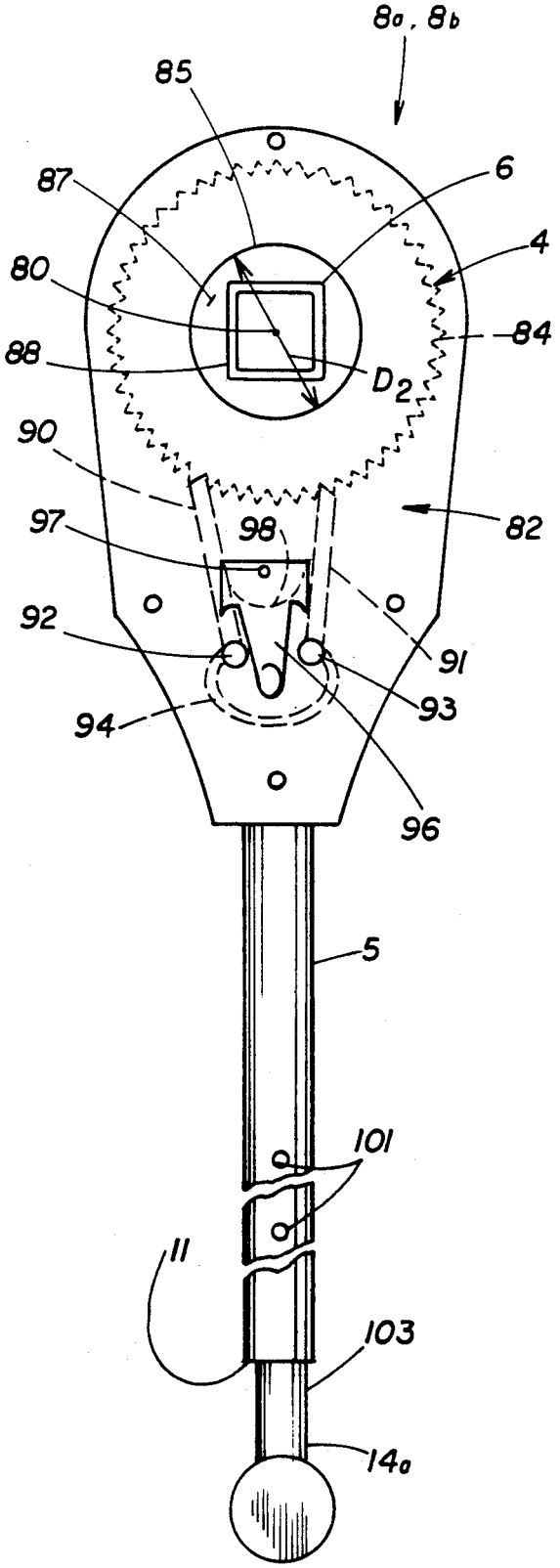
FIGS. 14 and 15 are front elevational and side detail views, respectively, of each crank arm including ratcheting means therefor.
Figure 15:
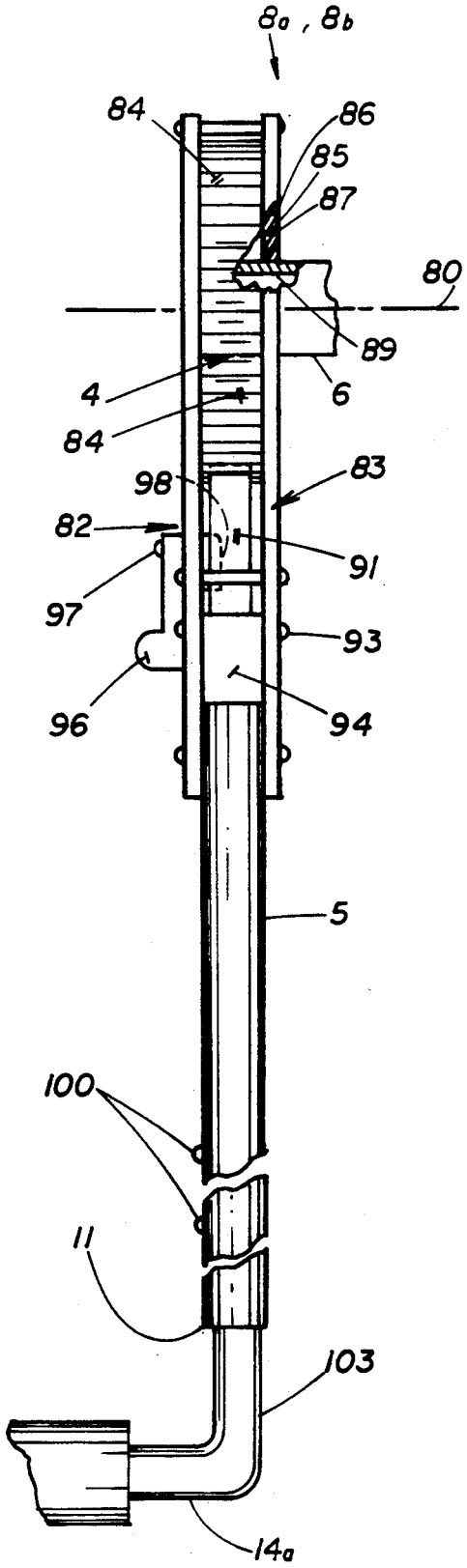

FIGS. 14 and 15 are front elevational and side detail views, respectively, of a crank 8*a* or 8*b* in combination with the ratchet mechanism 4 of FIGS. 1-3.

Each crank 8*a*, 8*b* is L-shaped and comprises forearm 5 and a lateral arm 6, the forearm 5 and lateral arm 6 being interconnected via the rachet mechanism 4. The forearm 5 includes an end 11 remote from the central housing 10 that is connectable to one of a series of action arms—separately—such as a L-shaped arm-handle 14*a* used for arm lifts, arms curls and arm stretches that can be operated over limited arcuate ranges, say 90 degrees to full 360 degrees rotation.

Each lateral arm 6 defines an axis of symmetry 80 coincident with the axis of symmetry 23 of the housing 10 which permits the ratchet 4 including the forearm 5 and arm-handle 14*a* to rotate about axis 80 in limited or full 360 degree rotation. In this regard, the ratchet 4 is provided with a pair of tear-drop shaped plates 82, 83 sandwiching a central gear 84. Each plate 82, 83 is provided with a central opening 85 of diameter D2 defining a side wall 86 into which a pliant bushing 87 is inserted. The pliant bushing 87 is also provided with an opening 88 that is square in cross section matched in shape and dimensions to those of lateral arm 6 so as to fixedly receive same. The gear 84 is also provided with an opening 89 that is square in cross section also matched in shape and dimensions to those of the lateral arm 6. But note that when the plates 82, 83 are rotated by forearm 5, each pliant bushing 87 of each plate 82, 83 also rotates about the axis 80, while the lateral arm 6 remains stationary assuming the gear 84 is not ratchetly engaged. But when the gear 84 is ratchetly attached to the plates 82, 83 via engagement of pawls 90 and 91 with the gear 84, rotation of the plates 82, 83 and gear 84 cause rotation of the lateral arm 6. Note in FIG. 14 that the pawls 90, 91 are rotatable about pins 92, 93 but are kept in contact with the gear 84 via C-shaped spring 94. In order to dislodge one or other of the pawls 90, 91 from contact with the gear 84, the ratchet 4 of the invention is provided with a release trigger 96 pivotable about pin 97 to bring cam surface 98 thereof into contact with such pawl 90, 91. Thus with the release trigger 96 in the mid position, the lateral arm 6 is rotated in concert with either clockwise or counter-clockwise movement of the forearm 5 so that the invention provides a super-set function of exercise. But if the release trigger 96 is rotated clockwise in FIG. 14, the cam 98 release pawl 90 from the gear 84. Hence counter-clockwise rotation of forearm 5 and arm-handle 14*a* causes rotation of the lateral arm 6 but the arm 6 is stationary when the forearm 5 is rotated in clockwise direction in FIG. 14, the pawl 91 sliding over the gear 84. And if the release trigger 96 is rotated counter-clockwise in FIG. 14, the cam 98 releases pawl 91 from the gear 84. Hence clockwise rotation of forearm 5 and arm handle 14*a* causes rotation of the lateral arm 6 but the arm 6 is stationary when the forearm 5 is rotated in counter-clockwise direction in FIG. 14, the pawl 90 sliding over the gear 84.

The pliant bushing 87 is formed of a material of low frictional coefficient. In this regard, any low frictional material may be employed, but the most advantageous has been found to be plastic because the latter provides excellent lubricating characteristics and at the same time the plastic does not fuse together under pressure.

Thus, the ratchet mechanism 4 of the invention permits the forearm 5 and arm-handle 14*a* to be operationally attached to the lateral arm 6 in a variety of operational modes, say both rotary directions about axis 80, in a clockwise direction only or in a counter-clockwise direction only.

The above description contains several specific embodiments of the invention. It is not intended that such be construed as limitations on the scope of the invention, but merely as examples of preferred embodiments. Persons skilled in the art can envision other obvious possible variations within the scope of the description. For example, various handle configurations can also be attached to the forearm 5 (via spring-driven pins 100 of FIGS. 14 and 15 that penetrate openings 101 after the handle 103 has been inserted interior of the forearm 5). Such operations permit the user to perform various pushing, pulling exercising for strengthening the arms, shoulders, back, legs, etc., and other parts of the body, particularly for professional athletes including weight lifters, body builders, football, baseball and basketball players, golfers, and race car drivers. Hence the scope of the invention is to be determined by the appended claims and their legal equivalents.

What is claimed is:

1. An exerciser which can be readily initialized for use while at the same time generate a distributed resistance load in which a user's limbs can be worked in push-pull, pull only, or push only movements, comprising:

a central, fixed housing having an axis of symmetry and a plane of action normal to said axis of symmetry, first and second cranks each having a lateral arm insertable within said fixed housing from opposite directions and having an axis of rotation coincident with said axis of symmetry for providing clockwise and counterclockwise rotation about said axis of symmetry, each of said first and second cranks including a forearm normal to said lateral arm and a ratchet mechanism for disconnectably connecting said forearm to said lateral arm, said lateral arm being square in cross section, first and second independently operating friction brakes each journaled to said each lateral arm of said first and second cranks, said each brake including a push block and a series of stackable, laterally slidable rotatable, and stationary members in edge relationship relative to said axis of symmetry and in planar surface contact with each other, said rotatable and stationary members being distributed over a finite length of said lateral arm of each said first and second cranks, common frictional biasing means in biasing contact with said push block of said each of said first and second friction brakes, said friction biasing means including activation rod means for generating bidirectional biasing squeezing pressure through said push blocks to said series of rotatable and stationary members of each of said first and second friction brakes whereby independent resistance to rotation of said lateral arm about said axis of symmetry is relatively smooth over a full 360 degrees of rotation of either said first or second cranks individually or in tandem, said ratchet mechanism of each of said first and second cranks comprising an independently rotatable gear journaled to said lateral arm of each of said first and second cranks, a pair of tear-drop shaped plates sandwiching said gear and disconnectably attachable thereto via a pair of retractable pawls and a trigger for individually activating said pawls, each of said plates including a bushing capable of providing rotation independent of said gear in accordance with activation of said trigger.

2. The exerciser of claim 1 in which said planar surface contact of said stackable, laterally slidable, rotatable and stationary members of said each first and second friction brakes is along parallel contact planes that are substantially normal to said axis of symmetry and substantially parallel to said plane of action of said housing, said rotatable and stationary members of each of said first and second friction brakes comprising at least three rotatable members and at least three stationary members stacked together to generate a resistance loading for said first and second brakes.

3. The exerciser of claim 2 in which said rotatable and stationary members of each of said first and second friction brakes comprises at least four rotatable members and at least four stationary members stacked together to generate a resistance loading for said first and second brakes.

4. The exerciser of claim 2 in which said housing and said stationary members are square in cross section and said stationary members are snugly received within said housing so as to prevent rotation thereof relative to said axis of symmetry of said housing, said housing also including end blocks of square cross section.

5. The exerciser of claim 1 in which each of said rotatable members of said first and second friction brakes is circular in cross section and in which each of said rotatable members also includes a central opening of square cross section penetrated by and operationally attached to said lateral arm of each first and second cranks.

6. The exerciser of claim 1 in which said push blocks are of square cross section and each push block includes a central opening of circular cross section and a bushing of pliant material positioned at said central opening and rotatably attached therewith, said bushing including an opening of square cross section in snug contact with said each lateral arm of said each first and second cranks penetrating therethrough wherein rotation of said lateral arm about said axis of symmetry of said housing causes similar rotation of said bushing relative to said push block.

7. The exerciser of claim 4 in which said end blocks each includes a central opening of circular cross section and a bushing of pliant material at its central opening rotatably attached therewith, said bushing including an opening of square cross section in snug contact with said each lateral arm of said each first and second cranks penetrating therethrough wherein rotation of said lateral arm about said axis of symmetry of said housing causes similar rotation of said bushing relative to said end block.

8. An exerciser which can be readily initialized for use while at the same time generate a distributed resistance load in which a user's limbs can be worked in push-pull, pull only, or push only movements, comprising a central, fixed housing having an axis of symmetry and a plane of action normal to said axis of symmetry, first and second cranks each having a lateral arm insertable within said fixed housing from opposite directions and having an axis of rotation coincident with said axis of symmetry for providing clockwise and counterclockwise rotation about said axis of symmetry, first and second independently operating friction brakes each journaled to said each lateral arm of said first and second cranks, said each brake including a push block and a series of stackable, laterally slidable rotatable and stationary members in edge relationship relative to said axis of symmetry and in planar surface contact with each other, said rotatable and stationary members being distributed over a finite length of said lateral arm of each first and second cranks, common frictional biasing means in biasing contact with said push block of said each of said first and second friction brakes, said friction biasing means including activation rod means for generating bidirectional biasing squeezing pressure through said push blocks to said series of rotatable and stationary members of each of said first and second friction brakes whereby independent resistance to rotation of said lateral arm about said axis of symmetry is smooth over a full 360 degrees of rotation of either said first or second cranks individually or in tandem, said activation rod means of said common frictional biasing means in biasing contact with said push blocks of said first and second friction brakes comprising a threaded rod rotatable about said axis of symmetry of said housing, a calibration member of square cross section having a central opening, a bushing fitted into said opening and attached to said bushing and a compression spring attached to said bushing, said bushing having a threaded opening in threaded contact with said rod whereby rotation of said rod is converted into rectilinear movement toward said first push block of said calibration member, said bushing and spring in a first direction and thence after the magnitude of spring force acting at said first push block becomes greater than the frictional forces acting on said rod, further rotation causes opposite rectilinear travel of said rod in the opposite direction, said rod including a flange welded adjacent to said second push block wherein said opposite movement of said rod draws said flange into contact with the second push block.

9. The exerciser of claim 8 in which further rotation of said rod causes bidirectional movement of both push blocks in opposite directions and hence squeezes said stationary and rotatable members of said first and second friction brakes together relative to said housing.

10. The exerciser of claim 8 in which said housing is provided with side and end walls and a slot is provided in one of said side walls in alignment with said calibration member wherein position of said calibration member relative to a scale adjacent said slot is used as an indicator of the magnitude of resistance loading of said first and second friction brakes.

11. An exerciser for providing resistance loads over a full 360 degree arc in a smooth manner for a user's limbs, comprising a central, fixed housing having an axis of symmetry and a plane of action normal to said axis of symmetry that intersects at least a portion of said user's body, first and second cranks manipulated by said user's limbs for rotation about said axis of symmetry of said housing, each of said cranks having a lateral arm insertable within said fixed housing from opposite directions, each of said first and second cranks including a forearm normal to said lateral arm and a ratchet mechanism for disconnectably connecting said forearm to said lateral arm, said lateral arm being square in cross section, first and second independently operatable friction brakes each journaled to said each lateral arm of said first and second cranks interior of said housing and including a series of edge stackable rotatable and stationary members squeezable together along broad surfaces in a manner that resists rotation of said lateral arms of said first and second cranks at essentially a constant magnitude of frictional pressure even though said cranks operate independently, common frictional biasing means including activation rod means in biasing contact with said each series of rotatable and stationary members of said first and second friction brakes for squeezing said each series at said constant magnitude of pressure whereby independent resistance to rotation of each of said lateral arm about said axis of symmetry is smooth, said ratchet mechanism comprising an independently rotatable gear journaled to said lateral arm, a pair of tear-drop shaped plates sandwiching said gear and disconnetably attachable thereto via a pair of retractable pawls, a trigger attached to said plates for independently activating said pawls, each of said plates including a bushing capable of providing rotation independent of said gear in accordance with activation of said trigger.

12. The exerciser of claim 11 in which said stationary members are each square in cross section and each stationary member includes a central plate and first and second planar layers sandwiched about said plate and constructed of a material having a high coefficient of friction, said central plate and said first and second layers having coextensive and aligned openings of circular cross section and of sufficient diametrical length so as not to interfere with operation of said lateral arm penetrating therethrough.

13. The exerciser of claim 12 in which first and second layers are constructed of leather.

14. The exerciser of claim 11 in which said first and second friction brakes also includes first and second push blocks at ends of said stacked rotatable and stationary members, said push blocks being of square cross section and each push block including a central opening of circular cross section and a bushing of pliant material positioned at said central opening and rotatably attached therewith, said bushing including an opening of square cross section in snug contact with said each lateral arm of said each first and second cranks penetrating therethrough wherein rotation of said lateral arm about said axis of symmetry of said housing causes like rotation of said bushing relative to said push block.

15. The exerciser of claim 11 in which said housing also includes first and second end blocks each including a central opening of circular cross section and a bushing of pliant material positioned at said central opening and rotatably attached therewith, said bushing including an opening of square cross section in snug contact with said each lateral arm of said each first and second cranks penetrating therethrough wherein rotation of said lateral arm about said axis of symmetry of said housing causes like rotation of said bushing relative to said each end block.

16. The exerciser of claim 14 in which said activation rod means of said common frictional biasing means is in biasing contact with said push blocks of said first and second friction brakes and comprises a threaded rod rotatable about said axis of symmetry of said housing, a calibration member of square cross section having a central opening, a bushing fitted into said opening and attached to said bushing and a compression spring attached to said bushing, said bushing having a threaded opening in threaded contact with said rod whereby rotation of said rod is converted into rectilinear movement toward said first push block, of said calibration member, said bushing and spring in a first direction and thence after the magnitude of spring force acting at said first push block becomes greater than the frictional forces acting on said rod, further rotation causes opposite rectilinear travel of said rod in the opposite direction, said rod including a flange welded adjacent to said second push block wherein said opposite movement of said rod draws said flange into contact with the second push block.

17. The exerciser of claim 16 in which said housing is provided with side walls parallel to said axis of symmetry and a slot, said slot being provided in one of said side walls in alignment with said calibration member wherein position of said calibration member relative to a scale adjacent said slot is used as an indicator of magnitude of resistance loading of said first and second friction brakes.

* * * * *